US005330188A

United States Patent [19]

Reimers

[11] Patent Number: 5,330,188

[45] Date of Patent: Jul. 19, 1994

[54] PUTTER ALIGNMENT SYSTEM

[76] Inventor: Eric W. Reimers, 1235 Starwood, Missoula, Mont. 59802

[21] Appl. No.: 795,665

[22] Filed: Nov. 21, 1991

[51] Int. Cl.[5] ..... A63B 69/36

[52] U.S. Cl. ..... 273/186.1; 273/35 A; 273/181 H; 273/183.1; 273/194 A

[58] Field of Search ..... 273/181 R, 181 H, 35 R, 273/35 A, 183 R, 183 A, 183 D, 186 R, 186 A, 186 AA, 186 B, 186 C, 192, 194 R, 194 A, 186.1, 186.2, 186.3, 183.1, 186 RA

[56] References Cited

U.S. PATENT DOCUMENTS

| | | | |
|---|---|---|---|
| 3,009,704 | 11/1961 | Heard | 273/186 R |
| 3,070,373 | 12/1962 | Mathews et al. | 273/194 R |
| 3,194,563 | 7/1965 | Mackniesh | 273/186 R |
| 3,390,388 | 6/1988 | Kahl, Jr. et al. | 340/258 |
| 3,752,978 | 8/1973 | Kahl, Jr. et al. | 250/340 |
| 3,802,709 | 4/1974 | Elkins, Jr. | 273/35 A |
| 3,953,034 | 4/1976 | Nelson | 273/194 R |
| 4,215,271 | 7/1980 | Mudge et al. | 250/216 |
| 4,251,077 | 2/1981 | Pelz et al. | 273/194 A |
| 4,270,751 | 6/1981 | Lowy | 273/64 |
| 4,306,722 | 12/1981 | Rusnak | 273/186 R |
| 4,341,384 | 7/1982 | Thackrey | 273/186 A |
| 4,411,431 | 10/1983 | Judice | 273/183 |
| 4,826,174 | 5/1989 | Hoyt, Jr. | 273/186 |
| 4,858,934 | 8/1989 | Ladick et al. | 273/183 A |
| 4,971,327 | 11/1990 | Rabold | 273/186 AA |
| 4,979,745 | 12/1990 | Kobayashi | 273/183 R |
| 4,997,189 | 3/1991 | Perkins | 273/35 A |
| 5,029,868 | 7/1991 | Cloud | 273/186 C |
| 5,082,276 | 1/1992 | Stevens | 273/183 D |

FOREIGN PATENT DOCUMENTS

| | | | |
|---|---|---|---|
| 52-51227 | 4/1977 | Japan | 273/186 A |

*Primary Examiner*—Jessica J. Harrison
*Attorney, Agent, or Firm*—Michael J. Hughes

[57] ABSTRACT

A putter alignment system (10) is provided for use in aiding in practicing golf putting. The system (10) includes a putter component (12) mounted on a golf putter (12) and a remote target component (14) situated along the desired relative alignment axis (18) from the putter (20). Electronic components are utilized to determine relative alignment of the putter (20) to the target by analyzing an electromagnetic signal "beam" (16). A preferred embodiment includes an emitter (68) on the remote component (14) and a reflector (50) on the putter component (12) to created and delimit the beam (16). The position of the beam (16) is detected by photosensors (69) while signal output is provided by signal lights (75) corresponding to the relative alignment. An alternate preferred embodiment uses a focused beam source (6110) on the putter (20) to direct the beam along the putter axis (49). Alternate signal outputs allow analysis of a putting stroke as well as of static prealignment.

12 Claims, 6 Drawing Sheets

PUTTER ALIGNMENT SYSTEM

TECHNICAL FIELD

The present invention relates generally to positioning and alignment apparatus and more particularly to devices utilized in order to align a golf putter with a desired target for practice purposes. The preferred embodiment of the present invention is a system which utilizes putter and target portions. The putter portion is placed on a golf putter and a corresponding remote component representing the target is usually placed in or in the vicinity of the golf hole for providing feedback to the user when the alignment of the putter is proper. The putter alignment system is primarily adapted for use during extensive practice to develop muscle memory, and is further adapted to be enhanced for use in stroke analysis.

DESCRIPTION OF THE PRIOR ART

Golf is certainly one of the most frustrating activities ever invented by the human species. The game is played by propelling a stationary and uniform ball toward a stationary target. This always looks as if it should be very easy.

However, as many million of golfers would readily testify, the game is much more difficult than it looks. Without even dealing with the vagaries of equipment, causing one's own muscles to repetitively perform the same motion is a nearly impossible task. Then, when a golfer wishes to make minor variations, such as adding additional power or altering the direction slightly in order to impart a desired bend or spin, the task becomes even more difficult.

One of the most frustrating areas of golf is putting. This activity takes placed on greens of varying degrees of difficultly, both as to texture and to topography. However, occasionally, the golfer will be faced with a puft on a green which appears to have perfectly uniform texture and no slope or "break" on the putt. Nonetheless, even these absolutely straight and even putts are subject to difficulties. The average golfer is more than fully capable of missing straight and flat putts of any length, even those of three feet and below.

Consequently, the pursuit of a straight and even putting stroke is a common activity of golfers of all ages and degrees of skill. Since there is very little more frustrating than missing a straight flat putt, a good deal of time is spent working on this particular aspect of the game.

Improving one's putting stroke and particularly, improving the alignment of the putting stroke, is a common subject of golf innovation. A perusal of any substantial number of popular golf magazines is certain to lead to one or more articles or features describing methods to improve the alignment of a putting stroke. These vary from placing the putter between two parallel boards so as to keep the stroke perfectly smooth, putting along strings or ropes, devices attaching to the golfer's hand or body to force a straight stroke, molded putter grips and a very wide variety of other efforts.

Some of the attempts to cause golfers to produce a more uniformly aligned putting stroke have been the subject of United States Patents. One such is disclosed in U.S. Pat. No. 4,826,174 issued to D. Hoyt, Jr. A primary feature of this disclosure is a structure which may be set up in such a manner as to force a linear stroke with the putter. A similar approach, including visual feedback is reflected in U.S. Pat. No. 3,934,874, issued to F. Henderson. Another approach is found in U.S. Pat. No. 4,411,431, issued to C. Judice, which discloses a golf ball/barbell structure which indicates the linearity of impact of the putter head with the golf balls. Yet another U.S. Patent which deals with this issue, albeit from a different angle, is U.S. Pat. No. 4,270,751, issued to S. Lowy, which utilizes an audible sound system to aid visually handicapped golfers in locating the holes and thus to align their putters.

As is clear from the extremely wide variety of devices and methods aimed at improving the linearity and alignment of a putting stroke, there remains a great deal of room of improvement in the field. Golfers will continue to look for methods to improve their habits and practice methods and to find ways to improve the quality of their golf game, and particularly, the putting stroke. Accordingly, any device or a method which provides improvement in consistency is in great demand.

BRIEF DESCRIPTION OF THE INVENTION

Accordingly, is an object of the present invention to provide a system for allowing a golfer to improve the alignment of the putter during setup. An extension of this object, in enhanced mode, improves alignment during a putting stroke. Both objects follow from the invention facilitating repetitive practice with positive sensory feedback.

It is another object of the present invention to provide a compact electronic system for determining alignment of a golf putter.

It is a further object of the present invention to improve a golfer's muscle memory by allowing repetitive practice of perfectly aligned placement of the putter.

It is still another object of the present invention to utilize sensory feedback to reinforce a proper alignment and a consistent putting stroke.

It is yet another object of the invention to permit a golfer to be certain that putter alignment is correct, thus eliminating "bad alignment but good stroke" as a possible reason for missed putts.

It is still another object of the present invention to provide a system which may be readily transported from location to location for use by the golfer as a practice aid.

It is another object of the present invention to operate effectively in varying light and background conditions.

The present invention is a system adapted for permitting a golfer to placing a putter in position to achieve proper alignment. The invention is adapted to be utilized either with a special putter or as an accessory to a standard putter to create a delimited electromagnetic beam along an axis perpendicular to the face of the putter head. By aligning the beam with the desired target the golfer may determine that the putter face is square to the target at set up. By incorporating enhanced sensory and recording output options, alignment at various points of the stroke, particularly at the point of impact, may also be monitored.

Briefly, a preferred embodiment of the present invention is a system adapted to aid a golfer in proper alignment of the putter with respect to a desired target. The system includes a putter component mounted on the putter and a remote target component which may be placed at a location of the golfer's choice, especially at an actual golf hole. The relative lateral perpendicularity of the face of the putter to the desired target is detected and signaled to the golfer by electronic means.

One preferred embodiment of the system of the present invention includes a putter-mounted component having a focusing reflective device adapted to be removably mounted on the golfer's usual putter. The focusing reflector reflects electromagnetic energy generated by an emitter mounted on the remote target, with the energy being reflected in a focused manner so as to create an effectively delimited beam. In the preferred embodiment, the beam has relatively constant intensity in a vertical plane segment (vertical alignment not being critical) but has a narrow width, equal to twice the width of the reflector. The relatively vertically constant characteristic of the beam makes the system usable on sloping greens or putting surfaces, or by golfer's who do not keep the putter blade vertically flat, while retaining alignment integrity in the surface plane.

An alternate embodiment of the system includes a putter component where a golf putter is modified to have a focused beam generation device mounted thereon at a position above the height of a golf ball such that the beam generator delivers a relatively narrow beam of light along an axis perpendicular to the club face of the putter head. In this alternate embodiment the beam generator is pivotable in a vertical plane in order to align on a target which is either above or below the location of the putter. In addition, in the alternate embodiment, the beam generation device is selectable either for continuous generation or generation in response to a specific activity such as impact with the golf ball.

A primary component of both of the discussed embodiments of the system is the remote target component which includes a beam receiving assembly, signal (sensory feedback) generation assembly and a support structure for holding the remote component in the vicinity of a desired target, usually a golf hole.

In both of the preferred embodiments, the remote component includes a photoelectric beam detection assembly having one or, preferably, an odd plurality of sensors. The alternate embodiment also utilizes beam focusing optics for delivering the beam to the sensors. The signal generation assembly includes one or more signaling devices which are adaptable emit either to a visual light signal or an audible beep, or both. Enhanced signal generation subassemblies including optional broadcast, recording and display means to provide more extensive analysis. The support structure is adapted to support the remote component at a position either directly above or behind a golf hole or at a position offset from the hole on the green or other putting surface.

A salient feature of the preferred embodiment is an analysis structure in which the strength of the beam generated is adjusted to compensate for the distance between the putter component and the remote component and other environmental factors which affect signal strength. This adaptive feedback feature permits the user to alter the practice parameters without the necessity of making manual adjustments to the components. The adaptive feedback feature further incorporates dynamic ranging to permit the system to operate with relatively equal effectiveness at differing putting distances and varied light and background conditions.

It is an advantage of the present invention that the sensory signal provided when the putter is in proper alignment allows the golfer to build muscle memory by repetition of a properly aligned putter placement.

Another advantage of the present invention is that the compact size of the electronic components makes the system extremely portable for use under a wide variety of conditions.

It is still another advantage of the present invention that the beam generation and receiver structure may be adjusted in such a manner as to minimize interference from other sources, thus eliminating false positive readings.

It is yet another advantage of the invention that optional signals may be utilized, including audible alignment signals and "catch and hold" features, thus permitting the golfer to retain visual contact with the putter head and/or ball during set up or stroke practice.

It is still another advantage of the present invention that the degree of focusing of the beam may be selected to a greater or lesser degree, allowing the golfer to practice over a range of alignment sensitivity circumstances, thus preventing discouragement from practice.

It is still a further advantage of the present invention that it is equally utilizable over a wide variety of terrains and lengths of putts.

It is another advantage of the putting alignment system that the target may be moved from location to location, thus allowing the golfer to practice putting at locations which are offset from the desired target, the golf hole. This is especially valuable in practicing on sloping greens and in honing techniques related to "reading" the green.

A further advantage of the preferred embodiment is that the dynamic ranging feature provides immediate and effortless adjustment to varying distance, background and light transmission conditions.

Yet another advantage of the present invention is that the components are light in weight and utilize low energy power sources, thus making them portable and easily operated.

These and other objects and advantages of the present invention will become clear to those skilled in the art upon review of the following specification, the accompanying drawings and the appended claims.

BEST MODE FOR CARRYING OUT THE INVENTION

The best presently known mode for carrying out the present invention is a putter alignment practice system having a putter component and a remote target component. An electromagnetic beam (slot) is utilized between the putter component and the target component to determine the alignment of the face of the putter blade during setup for the putting stroke and thus to aid the golfer in practice. It may also be feasible to generate output throughout a putting stroke for a wider range of practice. Although it is unlikely that the devices of the present invention will become legal for use in actual play, they are extremely useful in practice in allowing the golfer to achieve muscle memory as to the feel of the position of the putter when perfect alignment is achieved.

Figure 1:
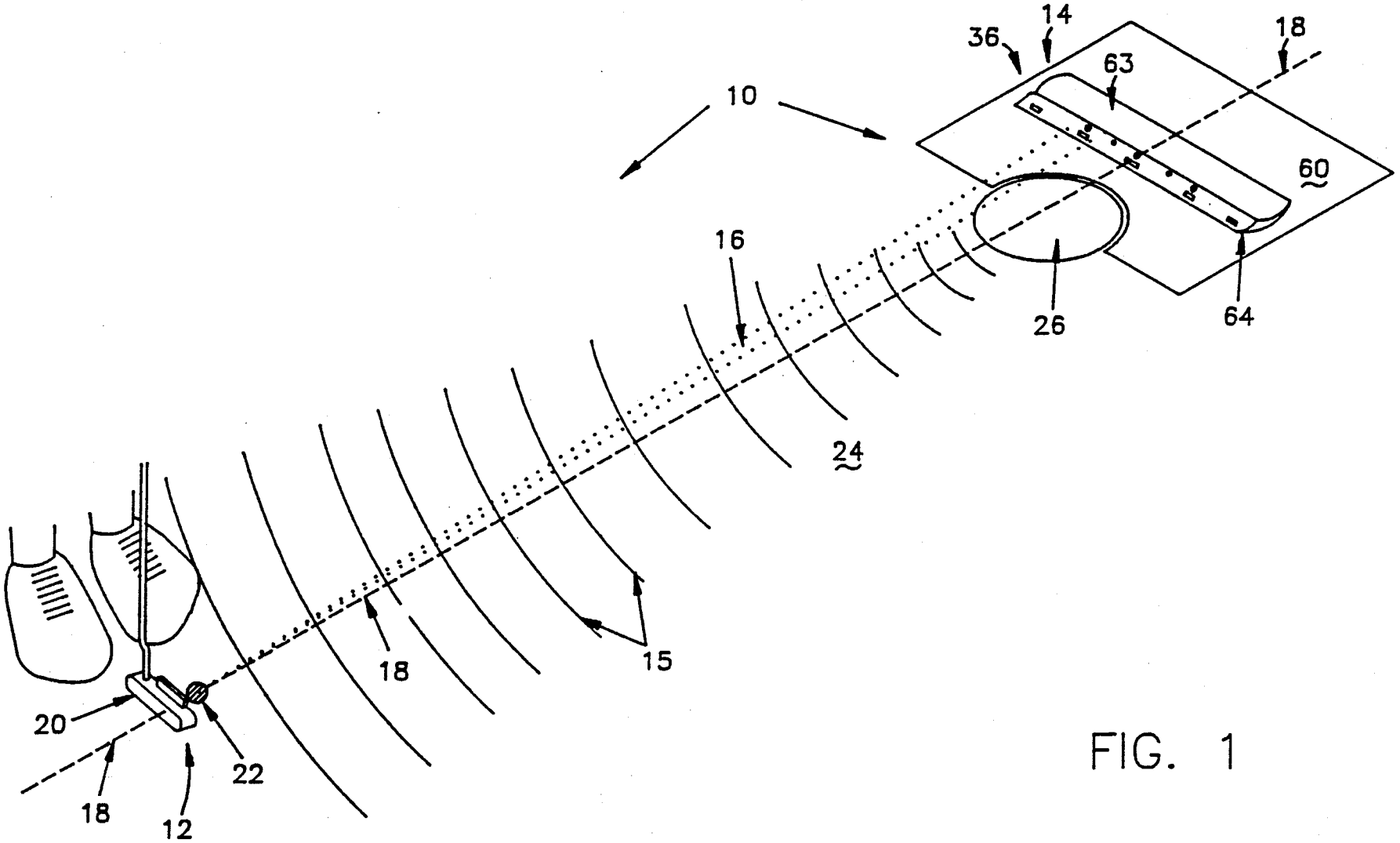
FIG. 1 is a fanciful perspective view of a golfer utilizing the system of the present invention for putting practice.

One preferred embodiment of the present invention is illustrated in fanciful perspective view in FIG. 1. In this illustration, a hypothetical golfer is shown practicing a putting stroke on a typical putting green utilizing the putting alignment system. The putting alignment practice system is referred to throughout by the general reference character 10 and, in all embodiments, includes a putter component 12 and a remote component 14. The putter component 12 and the remote component 14 are adapted to utilize a waveform 15 to generate relative positioning and alignment analogs. In the preferred embodiment 10, the waveform 15 causes an electromagnetic signal beam 16 which is not necessarily in the form of a conventional beam. However, "beam" 16 is the terminology utilized herein to refer to that portion of the waveform 15 which is delivered from the putter component 19, to the remote component 14 and is utilized to determine the positioning and alignment of the putter component with respect to the remote component 14.

A relative alignment axis 18 is defined as an axis, or a vertical plane, extending through the effective center of the putter component 12 and the remote component 14. Under ideal alignment conditions, the electromagnetic waveform signal beam 16 will also be directed along the relative alignment axis 18. When this correspondence is achieved, a proper alignment for the putter is also obtained.

The putter component 12 is adapted to be mounted upon a conventional golf putter 20 of the user's choice. In the game of golf, the putter 20 is utilized to stroke a golf ball 22 over the surface of a putting green 24 with the intent of causing the golf ball 22 to eventually enter a putting cup 26 (golf hole). Although it is possible to use a special putter particularly adapted for alignment practice, it is desirable that the preferred embodiment of the putter component 12 be utilizable with the golfer's preferred standard putter 20 so that the golfer may achieve the "feel" for the particular putter which corresponds with perfect alignment.

In the usage of the putting alignment system 10 of the present invention, the golf ball 22, the particular type of putting surface (a putting green 24, carpet or similar structure), and the putting cup 26 are optional accessories. The alignment benefit may be obtained without utilizing any of these, although most golfers will find that it is easier to practice if they use all of the necessary elements, particularly the golf ball 22, since it is more realistic and will result in better eye-hand coordination regarding alignment. If the system 10 is used for actual dynamic stroke improvement then the ball 22 is necessary to practice maintaining alignment through an impact situation.

The operational elements of the putting stroke alignment system 10 are carried either in the putter component 12 or the remote component 14. The significant subgroups of elements which are utilized in the preferred embodiment be are a beam generating assembly 28, a beam directing assembly 30, a receiver/sensor assembly 32 and a signal assembly 34. Each of these subgroups is mounted either on a component support assembly 36 which provides mounting support for those elements which are a part of the remote component 14 or on a putter mount assembly 38 which allows the putter component 12 to be mounted on the putter 20.

In the preferred embodiment 10, illustrated in FIGS. 1 through 5, the beam generating assembly 28, the receiving/sensor assembly 32 and the signal assembly 34 are all part of the remote component 14 while the beam directing assembly 30 is a part of the putter component 12.

Figure 2:
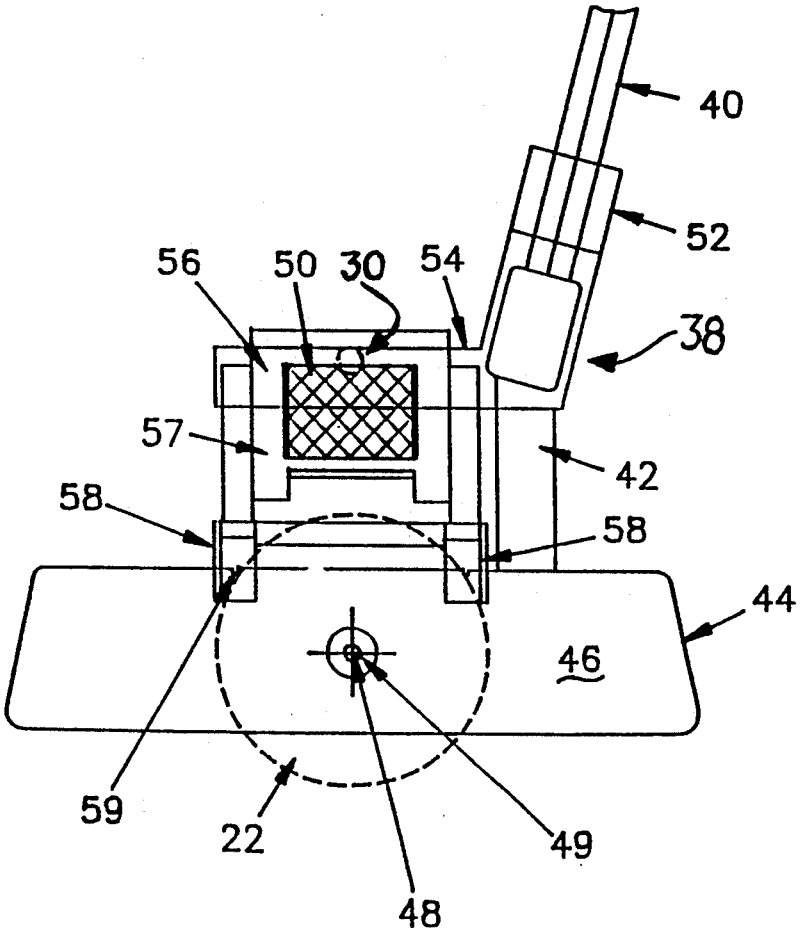
FIG. 2 is a partially cut away perspective view of a beam reflector of the preferred embodiment, mounted on a conventional golf putter.

Referring now to FIG. 2, the putter component 12, shown as attached to a conventional putter 20 by the putter mount assembly 38, is illustrated in a front elevational view. Since it is the object of the putting alignment system 10 to be utilized with the actual putter which the golfer utilizes in ordinary play, in order that the "feel" achieved may be retrieved during competition, the putter component 12 is adapted to be mounted via the putter mount assembly 38 on a conventional putter 20 of any of a variety of designs.

The particular style of golf putter 20 illustrated in FIG. 2 is for the purposes of illustration only, since there is a wide variety in standard golf putters. However, the typical golf putter 20, such as that illustrated in FIG. 2, includes a shaft 40 which extends upward to a grip portion (not shown) which is grasped by the golfer and a hosel portion 42 which provides the interface between the shaft 40 and a blade 44, which is the portion of the putter which actually impacts the golf ball 22. The impacting surface of the blade 44 is known as the face 46. Each golfer will have a personally desired location at which they wish the face 46 to impact the golf ball 22, but this position will ordinarily be near the center of the face 46. A golfer-defined optimum impact point ("OIP") 48 will therefore exist on the face of the putter 20 for each golfer.

For the purpose of understanding the invention, a putter axis 49 is defined as an axis perpendicular to the face 46 and passing through the optimum impact point 48. The putter axis 49, and the vertical plane containing it, represent the theoretical path of a putt where the ball 22 is impacted by the OIP 48.

The purpose of the putter mount assembly 38 in the preferred embodiment 10 is to support a reflector 50 which constitutes the primary component of the preferred beam directing assembly 30. The reflector 50 is adapted to be aligned exactly with the plane of the face 46 and normal to the putter axis 49 so that waveforms 15 emitted from the beam generating assembly 28 will impact the reflector 50 at the same angle as they would the face 46. The desired mounting location for the reflector 50 is centered over the optimum impact point 48, such that a vertical plane including the putter axis 49 will bisect the reflector 50.

The reflector 50 is selected so as to be absolutely flat in a horizontal plane so that the face is uniformly normal to the putter axis 49, when properly mounted. This assures that any waveform 15 impacting the reflector 50 along a path parallel to the putter axis 49 will be reflected back (forming the beam 16) along a path congruent to or parallel to the original path. In such a case, the beam 16 will be directed along the reference axis 18 and will correspond to perfect alignment. On the other hand, a portion of the wave form 15 intersecting the reflector 50 from a vector horizontally offset from the putter axis 49 will be reflected off at a complimentary angle in the horizontal plane.

Since the beam generating assembly 28 may be considered to be effectively a point source of the waveform 15, and since the returning beam 16 will travel a distance closely approximating the distance from the beam generating assembly 38 to the putter 12, the effective width of the beam 16 as it impacts the remote component 14 is equal to double the width of the reflector 50. This relationship obtains because the angle of reflection is equal to the angle of incidence. Thus the waveform 15 which is reflected from the reflector 50 and forms the beam 16 will be gradually divergent in the horizontal plane. The degree of divergence is double the width of the reflector 50 when the beam 16 has traversed a distance equal to the distance between the beam generating assembly 28 and the reflector 50.

Although the reflector 50 is ideally perfectly flat horizontally, it is selected to be convex with respect to the putter face 46 in a vertical plane. This shaping allows incoming waveform 15 arrays which are parallel to but vertically offset from the putter axis to be spread vertically such that the electromagnetic beam 16 reflected from the reflector 50 has a reasonable vertical height. This results in the reflected portion of the electromagnetic beam 16 being shaped into a vertically extending, horizontally narrow slot. That is, a planar screen inserted into the beam in a perpendicular fashion would show a vertically elongated rectangular image corresponding to the beam. This permits usage on sloped greens or at other position where the target is at a different elevation than the putter. It also validates practice by those golfers who maintain the putter face at a slope, rather than vertically. Since there is no necessity (although it may be helpful in achieving a good "roll") for the face 46 to be perfectly vertically aligned, a wide range of vertical alignments during a putting stroke may achieve equivalent results, while a slight change of horizontal alignment will cause substantially different results.

As noted above, the width of the diverging electromagnetic beam 16 extending from the reflector 50 illustrated in FIG. 2 will be closely related to (and a function of) the reflecting width of the reflector 50. For this reason, the sensitivity of the system 10 may be altered by masking or unmasking the edges of the reflector 50 so as to provide a narrower or wider effective electromagnetic beam 16. An optional shutter system 51 may be provided to alter this dimension and thus vary the sensitivity of the system 10. The shutter 51 is adapted to occlude the reflector equally on both sides so that the reflector 50 remains centered on the putter axis 49.

The particular putter mount assembly 38 show in FIG. 2 (as an example only) includes a hosel grip 52 which is adapted to fit over the hosel portion 42 of the putter For those putters which do not include a hosel portion the hosel grip 52 will fit over a lower extent of the shaft 40. The hosel grip 52 is adapted to be adjustably tightened so as to maintain firm vertical positioning of the reflector 50.

A cantilever portion 54 extends from the hosel grip 52 to a reflector bracket 56 in which the reflector 50 is mounted. A blade brace 58 extends downward from the reflector bracket 56 and is mounted on the blade 44 in a manner which prevents the putter mount assembly 38 from rotating about the shaft 40. In the illustration of FIG. 2, the blade brace 58 is shown as extending slightly over the face 46 of the putter 20. For some putter designs this may not be necessary as it would be possible to utilize a blade brace 58 which can achieve sufficient support from another portion of the blade 44. However, even in the illustration of FIG. 2, the blade brace 58 is thin enough and its face-overlapping positions are sufficiently offset from the optimum impact point 48 that the blade brace 58 should not have any adverse effect on the impact between the face 46 and the golf ball 24, at least on those strokes in which the golf ball 24 impacts the face 46 in the vicinity of the OIP 48.

Although a deluxe version of the mounting structure 38 is illustrated in FIG. 2, it is understood that the precise nature of the mounting structure is widely variable. An equally preferred alternate embodiment of the mounting structure eliminates the hosel grip 52 and cantilever portion 54. In such an instance, the blade brace 58 and the reflector bracket 56 are temporarily secured to the putter 20 by a removable adhesive 59 (shown in phantom) between the brace 58 and the blade 46. For most utilizations a removal adhesive 59 structure (or, with some putters, a magnetic attachment) is sufficient for the duration of time that the individual wishes to practice. However, as stated, the exact structure is a matter of choice.

As is discussed hereinafter with respect to alternate embodiments, the beam directing assembly 30 may be substantially different than the reflector 50 shown in the FIG. 2. In these instances, the specific design of the putter mount assembly 38 will be adapted to conform to the dimensions and shape of the components of the beam directing assembly 30 as well as being adapted to the shape of specific putters 20.

Figure 3:
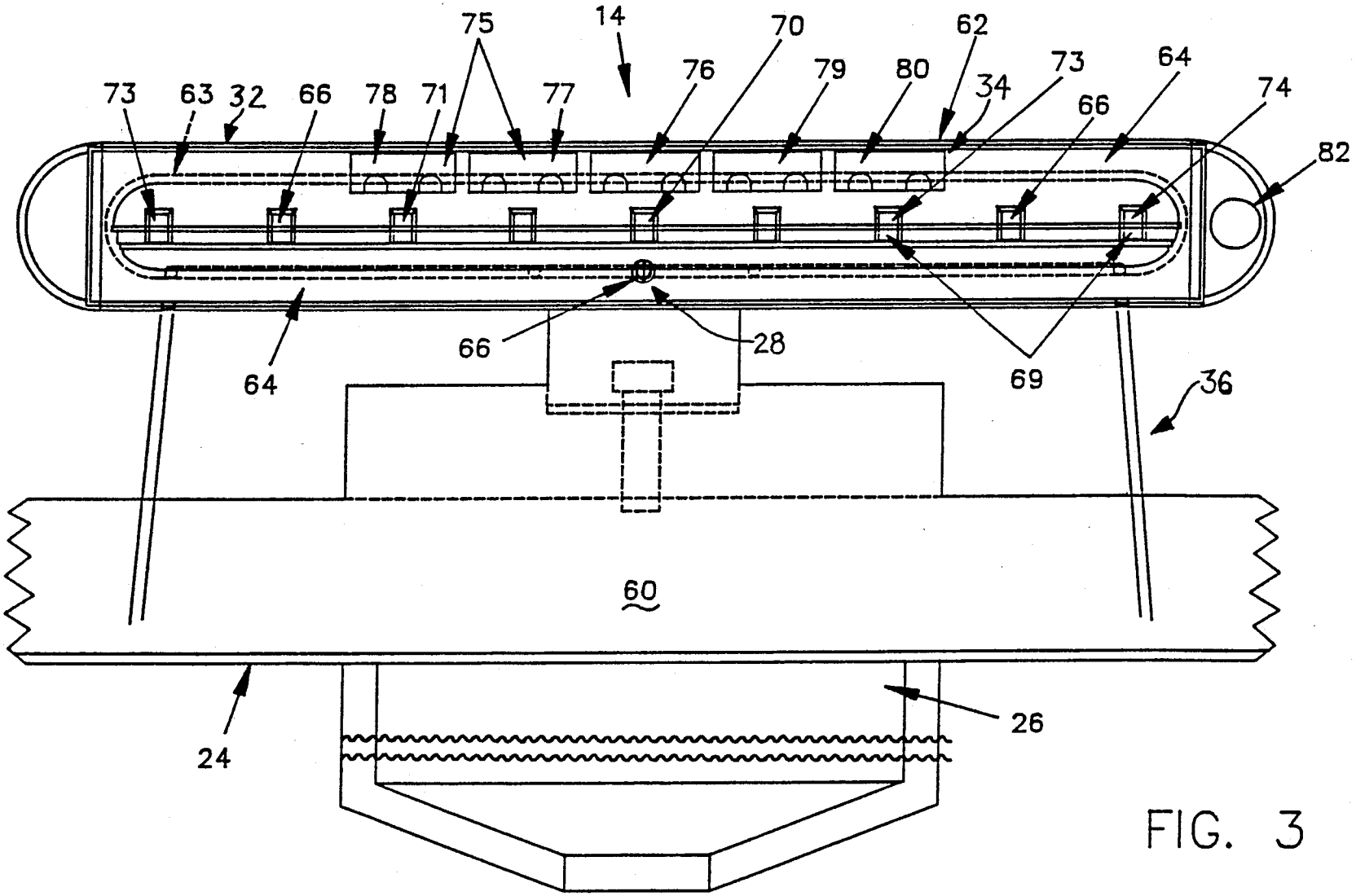
FIG. 3 is a front elevational view of a preferred remote assembly of the preferred embodiment, incorporating an emitter subassembly, a sensor subassembly and a signal subassembly.

Referring now to FIG. 3, a preferred embodiment of a remote component 14 is illustrated in conjunction with a putting cup 26. In this illustration it may be seen that the primary position securing structure of component base support assembly 36 is a positioning base 60 which holds the remote component 14 in proper position on the putting surface whether in conjunction with a golf hole 26 as illustrated in FIG. 3, or at some position on the putting surface 24 where no hole is present.

The particular positioning base 60 shown in FIG. 3 is only one possible means of supporting the active portions of the remote component 14. The particular structure is not a part of this invention. The positioning base 60 illustrated is adapted to provide a stable, cushioning support while being resistant to sliding motion. Since it is very likely that, during use, the positioning base 60 will be impacted by the golf ball 22, it is important to use a structure which will be stable and hold its position and also which will provide an impact cushion such that the electronic components are not damaged. The presently preferred base is a shock absorbing material, such as a thick rubber mat, with a hole simulating portion and a support post upon which to mount the component support assembly 36 at a height sufficient to prevent the golf ball 22 from interfering with the beam 16. Other support structures, such as integral legs or the like, would also be usable.

The component support assembly 38 is adapted to enclose and support all of the electronic components which permits the operation of the putter alignment system 10. In the preferred embodiment the beam generating assembly 28, the receiver sensor assembly 32, and the signal assembly 34 are all contained within the component support assembly 36. It may be seen in illustration of FIG. 1, the component support assembly 38 includes a component housing 62 which includes a generally boxlike rear portion 63 and rounded face portion 64, which is adapted to face in the direction of the putter 20. When the system 10 is utilized in conjunction with a golf hole 26, as in FIG. 1 and 3, the face plate portion 64 is arrayed perpendicularly to the alignment axis 18 and is placed directly behind the golf hole 26, in order to provide the most desirable target.

The front of the face plate 64, which faces the putter component 12, is provided with a plurality of apertures 66. These apertures 66 provide access to the beam generator 28 and the receiver/sensor assembly 32 components and allow the visual components of the signal assembly 34 to be seen by the user. The apertures 66 are carefully spaced as will be discussed hereinafter.

Directly aligned with one of the apertures 66 situated in the latitudinal center of the face plate 64, an emitter 68 is provided. The emitter 68 is the external portion of the beam generating assembly 28. In the preferred embodiment 10 the emitter 68 is a Light Emitting Diode (LED) adapted to emit either visible light on the red end of the visible spectrum or infrared radiation at a wavelength slightly beyond the visible spectrum. This nature of electromagnetic radiation is selected for good transmission and reflection characteristics over short ranges and also due to the fact that frequency-specific emitters and sensors are available in these ranges. For a variety of reasons, including economy of manufacture and moderate power supply requirements, the power level of the emitter 68 is relatively low.

The receiver/sensor assembly 32 is also contained within the housing 62. The preferred sensing elements are a plurality photosensors 69 attuned to the same range of wavelengths as those generated by the emitter 68. In the preferred embodiment 10 of the invention, five apertures 66 in the face plate 64 provide access to active photosensors 69. The active photosensors 69 include a center sensor 70, a slight left offset sensor 71, an extreme left offset sensor 72, a moderate right offset sensor 73 and an extreme right offset sensor 74.

The center sensor 70 is adapted to be vertically coplanar with the desired target location, ordinarily the center of the putting cup 26. The reference alignment axis 18 is defined as the axis including the center sensor 70 and the optimum impact point 48. When the putter axis 49 and the alignment axis 18 coincide, then perfect alignment is achieved. Since the emitter 68 is vertically coplanar with the center sensor 70, the portion of the waveform 15 impacting the reflector 50 is congruent with the return beam 16 in this alignment array.

The left offset sensors 71 and 72 and the right offset sensors 73 and 74 are equally spaced horizontally from the center sensor 70 so as to provide sensing of the electromagnetic beam 16 when the putter axis 49, and, correspondingly, the electromagnetic beam 16, are offset to the right or left of the alignment axis 18. The moderate left offset sensor 71 and the moderate right offset sensor 73 are provided to permit a means for determining whether the golfer's alignment is close to the optimum result, but slightly rotated to the left or the right. The extreme left offset sensor 72 and the extreme right offset sensor 74 detect somewhat greater degrees of misalignment.

Although the preferred embodiment is illustrated as having two left offset sensors 71 and 72 and two right offset sensors 73 and 74, it may be desirable to include additional offset sensors. An odd plurality is desired in order to maintain symmetry, with these equally spaced to left and the right of the center sensor 70. A larger number of sensors 69 will allow a greater degree of specificity as to the alignment and will also provide a larger target for the golfer to achieve rough alignment.

The signal assembly 34 of the preferred embodiment is in the form of a series of signal lights 75 corresponding to the photosensors 69. The signal lights 75 are adapted to be visible through corresponding apertures 66 and include a center light 76, a moderate left offset light 77, an extreme left offset light 78 a moderate right offset light 77 and an extreme right offset light 80. The signal lights 75 are adapted to correspond with an appropriate intersection of the waveform beam 16 with one (or more) of the photosensors 69. The width of the electromagnetic beam 16, the separation of the photosensors 69 and the signal intensity threshold necessary to activate the signal lights 75 will all determine whether one or more of the signal lights 75 will be actuated by a particular positioning of the putter 20.

As will be seen in FIG. 3, there are actually several additional apertures 66 in the row with those having associated sensors 69. These "dummy" apertures are provided for aesthetic purposes and are intended to assuage the concerns of the golfer who might be confused upon seeing signal lights which are not spatially correspondent to a sensor aperture.

The desirability of the dummy aperture is apparent from a review of FIG. 3 where it may be seen (for example) that the moderate left offset sensor 71 is arrayed outside of the moderate left offset light 77. Due to the divergent nature of the reflected beam 16, as discussed above, the beam 16 impacts the sensors 69 at double the angle of offset from the putter axis 49 than is actually the case. Consequently, the signal lights 75 represent the actual alignment of the putter 20 (reflector 50) but the sensor alignment necessary to sense the corresponding beam 16 must be offset by double the distance. The array of sensors 69 will thus be twice the width of the corresponding signal array as a consequence of the reflective system.

An optional additional component of the signal assembly 34 is a klaxon or beeper 82 which provides an audible signal corresponding to the impact of the electromagnetic beam 16 on the photosensors 69. The klaxon 82 is desirable in that it allows for an auditory signal to the golfer which is indicative of the degree of alignment. An auditory signal is often desirable in that it does not force the golfer to break off eye contact with the golf ball 22 during prealignment or during the putting stroke in order to determine the alignment situation. One form of klaxon 82 will have a varying volume depending on the intensity of the electromagnetic beam 16 impacting the center sensor 70. Another possible klaxon 82 would have differing tones or tone sequences depending upon which of the photosensors 69 was being impacted. An audible alignment signal could be in any form desired by the manufacturer, with the signal generating assembly altered to produce the desired output.

Figure 4:
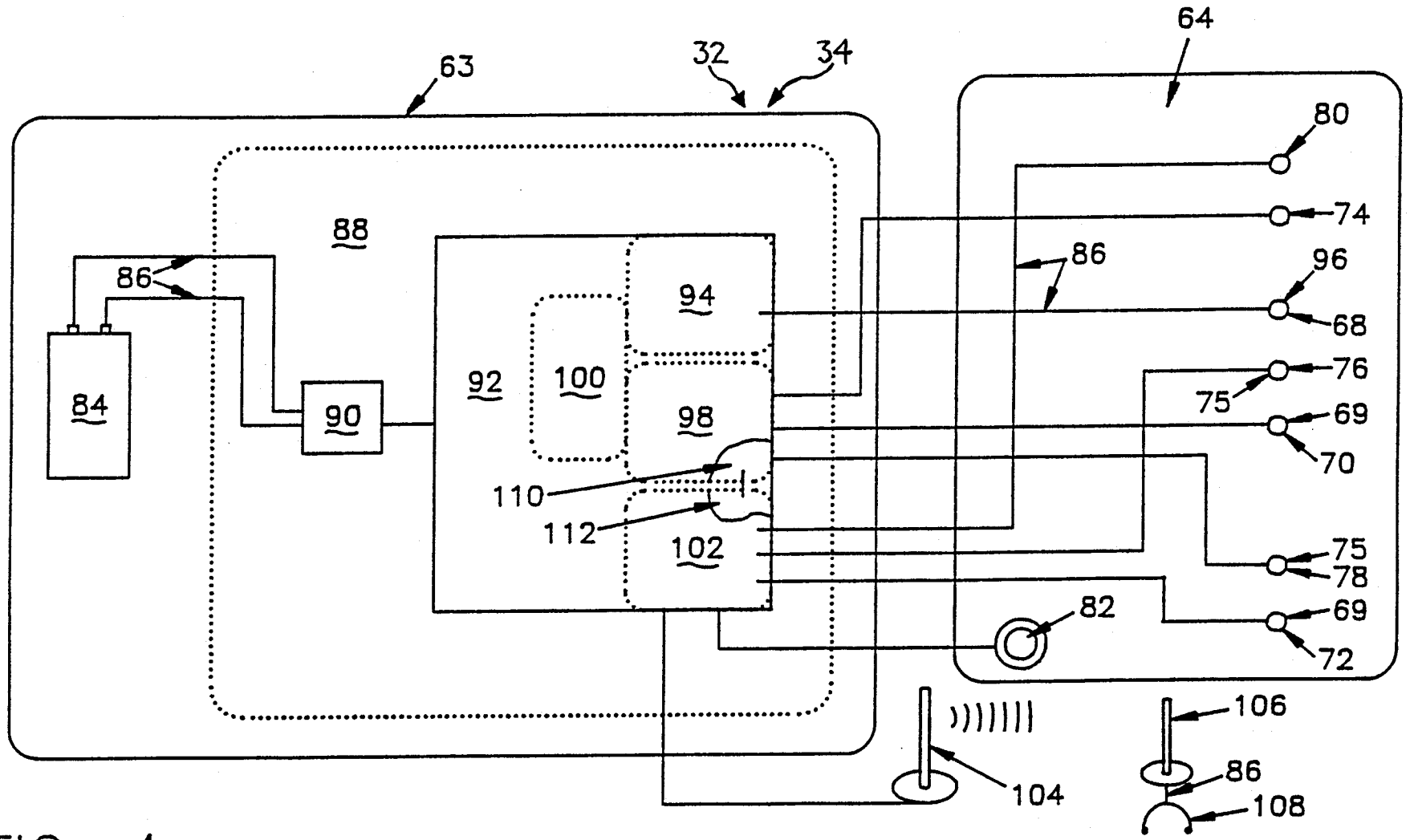
FIG. 4 is a fanciful block diagram of the arrangement of electronic elements of the remote assembly of FIG. 3.

FIG. 4 is a rough schematic view of the electronic portion of the remote component 14 of the preferred embodiment 10, as illustrated in FIG. 3. The version shown in FIG. 4 is somewhat simplified for the purposes of illustration, showing only three each of the sensors 69 and signal lights 75. These components will be enclosed in the housing 60 with some being situated in the rear portion 63 and others in the face portion 64. In the diagram of FIG. 4, it may be seen that a power supply 84 is adapted to provide electrical power to the beam generating assembly 28, the receivers/sensors assembly 32 and the signal assembly 34 over a variety of electrical leads 86, with all of the electronic components being supported on a typical circuit board 84. The typical power supply 88 is a nine (9) volt battery adaptable for easy replacement or recharging.

One necessary element of the circuitry is an on/off switch 90. The on/off switch 90, which has at least a portion thereof accessible from the exterior of the housing 60, controls the delivery of power to the other components.

Electrical power from the power supply 84 passes through the on/off switch 90 and is then, assuming the "on" position is selected, delivered to a series of components on the circuit board 88 which are referred to generally as a central processor unit 92. In the preferred embodiment the various functions performed by the central processor unit 92 are physically distinguishable only by a very careful analysis. Furthermore, these may be contained on a single microchip and not visibly distinguishable. Accordingly, since it is within the skill of those in the art to construct a central processor unit 92 capable of performing the various functions which will be described hereinafter, the illustration shows the functional areas in a nebulous fashion. It is understood that the physical separation of the functional components of the central processor unit 92 are for purposes of illustration only and do not necessarily represent any physical reality.

A portion of the leads 86 connect the on/off switch 90 to the beam generating assembly 28. The beam generating assembly 28 includes an emitter control 94 and an emitter LED 96 which is, in the preferred embodiment 10, the emitter 68. The emitter control 94 will ordinary be in the form of a chip which controls the intensity of the electromagnetic radiation from the emitter LED 96 by modulating the voltage delivered thereto. This modulation is discussed hereinafter in connection with the adaptive feedback features. Other functions may also be performed by the emitter control 94. For example, the emitter 68 may not be in continuous operation but may be on a blinker or timer pattern or may be activated in response to specific conditions.

A second functional section of the central processor unit 92 is a sensor analyzer 98. The sensor analyzer section 98 is adapted to receive and process electrical signals generated by the photosensors 69. The sensor analyzer 98 is adapted to perform a variety a functions, including filtering signals, setting threshold levels for activation of the signal assembly 34, signal strength comparison and other functions known to those skilled in the art. In particular, the sensor analyzer 98 is adapted to determine which of the photosensors 69, if any, is in the path of the waveform beam 16 as it is received from putter component 12.

One of the functions of the sensor analyzer 98 relates to the intensity of signal which is received from the photosensors 69. The sensor analyzer 98 cooperates with another functional area of the central processor until 92, a feedback control 100, to modulate the power delivered to the emitter 68 and, accordingly, the strength of the electromagnetic beam 16. This is accomplished by time and intensity analysis and causes the feedback control 100 to modulate the emitter control 94 such that the intensity of the electromagnetic radiation generated by the emitter LED 96 is greater or lesser within a specified range. This function is more fully discussed hereinafter in relation to FIG. 5.

A primary output of signals generated by the sensor analyzer 98 is to the signal control 102, which directs the electrical energy in such a manner that it activates the desired form of sensory feedback mechanism. In the preferred embodiment, the signal control 102 will activate the signal lights 75 which correspond with the photosensors 69 being impacted by the reflected beam 16.

Depending upon the width of the reflector 50 (and, hence, the beam 16) and the settings of the sensor analyzer 98 (which may, under some conditions, be user adjustable), two of the signal lights 75 may be activated simultaneously. For example, if the putter 20 is aligned so that the putter axis 49 is slightly offset to the right of the alignment axis 18, the waveform beam 16 might impact the center sensor 70 and the moderate offset right sensor 73 with approximately equal intensity. This condition will permit the sensor analyzer 98 to generate a positive signal with respect to both the center sensor 70 and the moderate offset right sensor 73 and the signal control 102 will thereby activate the center light 76 and the moderate right offset light 79. This informs the golfer that alignment is very close to correct but is slightly offset to the right.

The signal control 102 may also determine the duration of the signal. For example, it may be desirable to maintain the illumination of a signal light 75 for an interval longer than the interval of actual beam alignment.

If alternate methods of sensory feedback to the golfer are utilized the signal control 102 will also provide activation to these alternates methods. The klaxon 82 has been previously described. Another alternate approach is to utilize a transmitter 104. The transmitter 104 may be utilized to transmit signal information from the signal control 102 to a remote receiver 106 which is ordinary situated in close proximity to the golfer. The remote receiver 106 will then translate the signals from the transmitter 104 to a sensory signal generator 108 which informs the golfer directly of the alignment status. The precise nature of the sensory signal generator 108 can vary substantially. Although the sensory signal generator 108 illustrated in FIG. 4 is a stylized representation of a pair of headphones, which would be useful for an auditory alignment signal, other methods, such as a vibratory device in contact with the golfer's body or a visual display which may be placed on the putting surface 24 close to the golf ball 22 may also be utilized. A significant advantage in utilizing a sensory signal generator 108 which is in close proximity to the golfer is that the golfer is not tempted to look up to early from the stroke in order to view the signal lights 75 which are on the remote component 14. Any mechanism which permits the golfer to receive the necessary information with the minimal alteration of the normal putting prealignment and/or stroke is desirable. This is helpful in allowing the golfer to achieve a practice routine which is as closely analogous as possible to the actual putting stroke on the golf course during competition.

The precise nature of the sensory signal generator 108 will be dependent on the style of the particular golfer. Many golfers prefer to look only at the vicinity of the golf ball 22 during a putting stroke and do not look at the putting cup 26 at all. Others utilize different methods, including some who look only at the hole once the alignment has been achieved. For this reason, a variety of sensory signal generator 108 means are envisioned.

One feature which is incorporated into the preferred embodiment 10 is a signal interruption sequence. This is accomplished by a recognition analysis module 110 within the signal analyzer 98. The recognition analysis module 110 is circuitry adapted to recognize a particular pattern of signals from the sensors 69 and to activate a timed interrupt 112 in the signal control 102. The timed interrupt 112 disables the output of the signal control 102 for a predetermined interval and then reenables the output at the end of the interval.

The signal interruption feature is desirable in that it is used by the golfer in order to test the golfer's own unaided alignment on the target. A predetermined action, in the preferred embodiment a rapid side to side flick of the putter 20, causes the beam 16 to impact the sensors 69 in a pattern which is recognized by the recognition analysis module 110. This results in activation of the timed interrupt 112 for the predetermined interval 5-10 seconds), during which interval the outputs (only) of the signal control 102 are turned off. This permits the golfer to attempt to achieve perfect alignment during the interval without the "crutch" of the alignment system 10. This is valuable in that the unaided alignment is more analogous to competitive conditions and also provides positive or negative feedback to the golfer on the efficacy of the alignment by reactivation of the signal output at the conclusion of the interval.

It is also contemplated that an embodiment may be utilized which incorporates the "catch and hold" features is an impact instant analysis module. For this module an additional sensing/signaling components is provided on or in the vicinity of the putter component 12 for sensing the instant that the putter blade 46 impacts the golf ball 22 and delivering a corresponding signal to the remote component 14. The corresponding signal will then be recognized by the components similar to the recognition analysis module 110 and will result in activation of a circuit component which "catches" the signal output as of the instant of impact and holds that output for a predetermined interval to allow the golfer to see the actual alignment condition at the instant of impact, the alignment condition which is most critical to the actual putting stroke result.

Although a variety of mechanisms and electronic schemes may be utilized to accomplish this result, one presently contemplated structure includes a sound activated mechanism. In this proposed embodiment an audio sensor is placed a predetermined distance from the ball prior to the stroke. The audio sensor senses the unique sound of the impact and delivers a distinct electromagnetic signal to the remote component. The remote component includes recognition elements to recognize the distinct signal and to trigger an output override. The remote component will also include a delay subcircuit which will maintain the output signals generated a predetermined delay interval previous by the signal control 102. The delay interval is selected to compensate for the time necessary for the sound waves to travel from the impact position to the audio sensor (hence the predetermined distance of separation), plus a delta to indicate an instant immediately prior to impact (thus compensation for any alteration of alignment caused by the impact itself). When the output override is triggered, the output of the delay subcircuit is frozen and is displayed on the signal lights 75 for an assessment interval, after which normal operation of the system is restored. Alternatively, the frozen output may be held indefinitely until released by some action of the golfer.

Various other ways of accomplishing the goal of impact instant capture will be clear to those skilled in the art. The desirability of this enhancement feature will also be apparent to any golfer wishing to obtain the maximum benefit from the invention.

Figure 5:
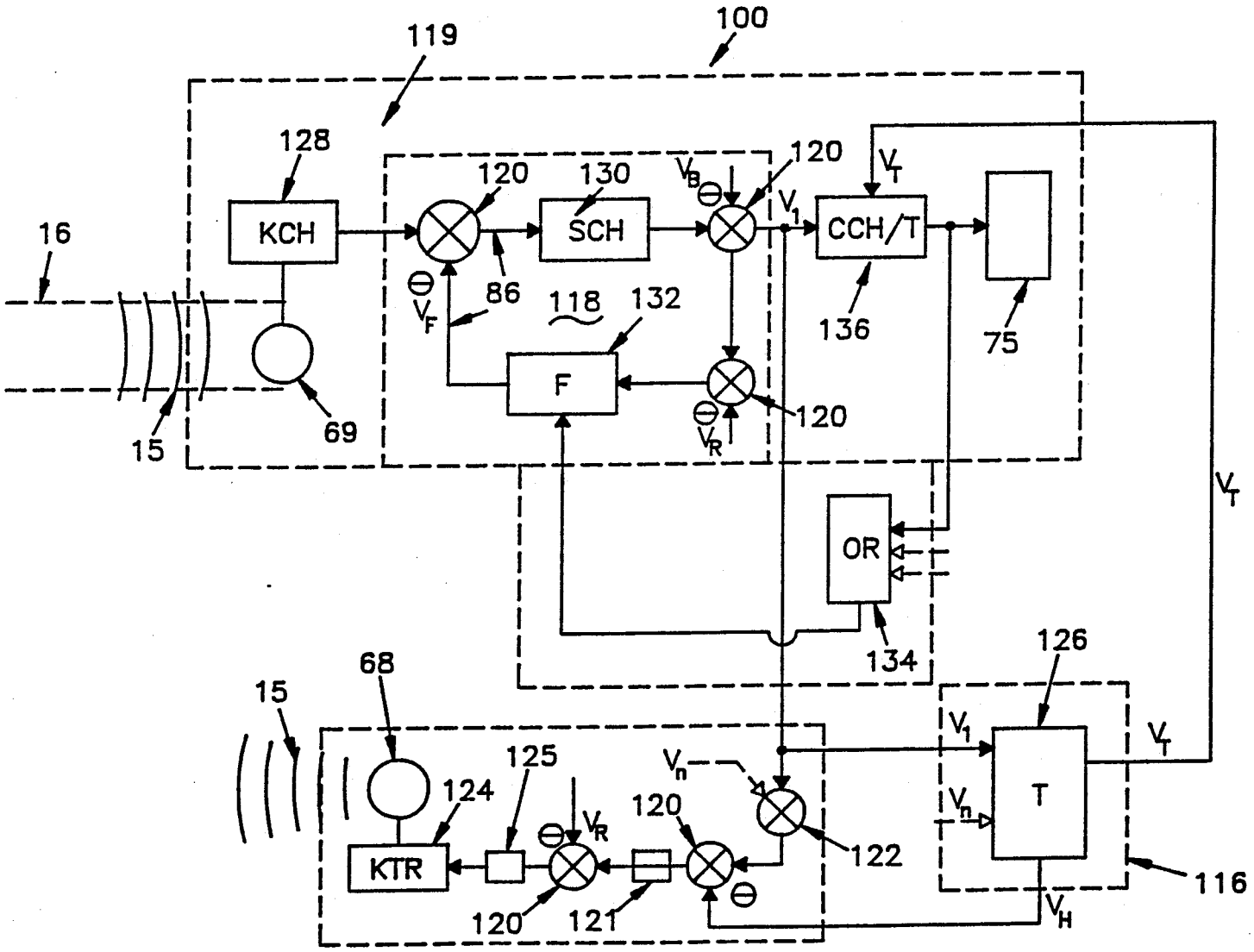
FIG. 5 is a functional block diagram of the adaptive feedback assembly.

Referring now to FIG. 5, a fanciful block diagram of the feedback control module 100 is provided. The feedback control 100 is provided to make the operation of the preferred putting practice alignment system 10 as automatic and versatile as possible. The feedback control module permits the system 10 to operate effectively over a variety of distances and environmental conditions and despite minor variances and irregularities in the components and circuitry.

The feedback control module 100 of the preferred embodiment includes three types of adaptive loops. The first of these is an emitter gain loop 114 which acts to adjust the gain of the emitter control 94 such that intensity of the beam 16 is such that the signals from impacted sensors 69 fall within a selected range. The second type is a threshold loop 116 which continually adjusts the level of electrical signal strength required to activate the output of the signal control 102. The third type is a channel calibration loop 118 which adjusts the electrical output characteristics of each of a plurality of channels 119. Each of the channels 119 includes a sensor 69 and its associated components. The channel calibration loops 118 are provided to compensate for background variations, component inconsistencies, and electrical anomalies in the circuits. One channel calibration loop 118 is provided for each channel 119, although only one example loop 118 is illustrated in FIG. 5.

The emitter gain loop 114 is a high gain, very fast loop which is always active when the system 10 is "on". The threshold loop 116 is also very fast and always active. On the other hand, each of the channel calibration loops 118 is slow in comparison to the emitter gain loop 114. The channel loop 118 are adapted to be "off" when any one of the sensors 69 is in the path of the beam 16. The channel loops retain "memory" of calibration parameters while in an "off" state so no detriment to performance occurs.

Although the specific electronic configuration of each of the loops (and of the other circuitry embodied in the invention 10) is apparent to those skilled in the art from the functions performed, a brief identification discussion is herein provided. It is emphasized that the particular components and parameters selected and described do not constitute an exhaustive listing and instead represent only a single embodiment of this portion of the invention.

Each of the loops includes functional components in the form of summing junctions 120 and at least one averaging resistor array 121 is also present to balance signal levels. In the preferred feedback control 100 illustrated in FIG. 5, all of the summing junctions 120, with the exception of one multi-input summing junction 122, shown in the drawing, are actually subtractive in nature and involve summing the negative of a selected input (usually a reference) to a signal component.

Briefly, the emitter gain loop 14 utilizes the sum of the outputs of all of the channels (subtracting the highest $V_H$) and the comparison to a reference voltage $V_R$ (in the preferred embodiment +2 volts) and, in the emitter modulator component designated $K_{TR}$ 124 modulates the output of the emitter 68 to provide a result in the desired range. This fast, highly adaptive loop 114 constantly modulates the intensity of the waveform 15 emitted by the emitter 68 to provide sufficient signal strength to compensate for changes in distance and environmental parameters. A noise rejector component 125, or dead band block, is provided prior to the emitter modulator 124 to prevent undue modulation of the output of the emitter 68 in response to irrelevant noise.

The threshold loop 116 is primarily a comparison and selection module operating purely on the outputs from the various channels 119. A threshold analyzer (T) 126 is provided to receive, as inputs, the outputs ($V_n$) of each of the channels 119 and to generate a comparison threshold output ($V_T$) and a high value output ($V_H$) which are utilized in the other loops. The high value output $V_H$ is merely the highest of the outputs of the various channels 119 and is used in the emitter gain loop 114 while the comparison threshold output $V_T$ is in the form of the average of the highest and lowest outputs from the channels 119, plus a delta factor to prevent a positive result when all channels 119 have approximately equal outputs (no intersection between the beam 16 and any of the sensors 69).

Each of the channels 119 utilizes continually updated information from the threshold loop 116 ($V_T$) for modulation and comparison. A channel gain modulator ($K_{CH}$) 128 receives the output of the associated sensor 69. The channel gain modulator 128 is a combination of gain components and band pass filters and provides an output to the channel calibration loop 118. The channel calibration loop 118 includes a synchronous amplifier (F) 130, a feedback demodulator ($S_F$) 132 and three of the subtractive summing junctions 122, to operate on inputs including the output of the channel gain modulator ($K_{CH}$), the reference voltage ($V_R$) and a background baseline voltage ($V_B$), the "memory" baseline, which generally corresponds to minimum signal level in a sensor from generic background conditions. The synchronous demodulator 130 operates on the same timing signal as the emitter 68 such that the proper wavelength signal may be enhanced while noise is attenuated thereby. The feedback amplifier 132 is an operational amplifier which acts to deliver a steady state signal ($V_F \sim V_R$) to the synchronous demodulator under background conditions.

The channel calibration loops 118 are intentionally selected to be slow with respect to the other loops 114 and 116. The channel calibration loops 118 are intended to provide calibration in response to extended duration conditions, such as general background conditions and variations in the electronic components. Short duration events, such as a person wearing reflective shoes or pants walking through the path, are intended to have a minimal impact on the calibration loop 118. Further, a positive signal interrupt 134 is provided to interrupt the calibration effect whenever any one of the channels 119 generates a positive result (intersection of the associated sensor 69 with the beam 16). The positive signal interrupt 134 thus prevents the beam 16 itself from interfering with the background calibration.

The output of the channel calibration loops 118 is a channel output voltage ($V_n$, $V_1$ for channel 1 as illustrated) analogous to the intensity of the waveform 15 impacting the sensor 69. This output goes to the threshold analyzer 126, the positive summing junction 122 and to a comparator 136 associated with the corresponding signal light 75. The comparator 136 compares the channel output ($V_n$) with the threshold voltage ($V_T$) and, if Vn is greater, activates the corresponding signal light 75 or other sensory signal output.

In this manner, the feedback control 100 operates to calibrate the electronics to general background conditions, manufacturing variations, the distance from the remote component 14 to the putter component 12 and short duration background condition changes, all without effort on the part of the golfer. This is highly desirable in encouraging practice, since non-operational environmental factors are minimized.

Figure 6:
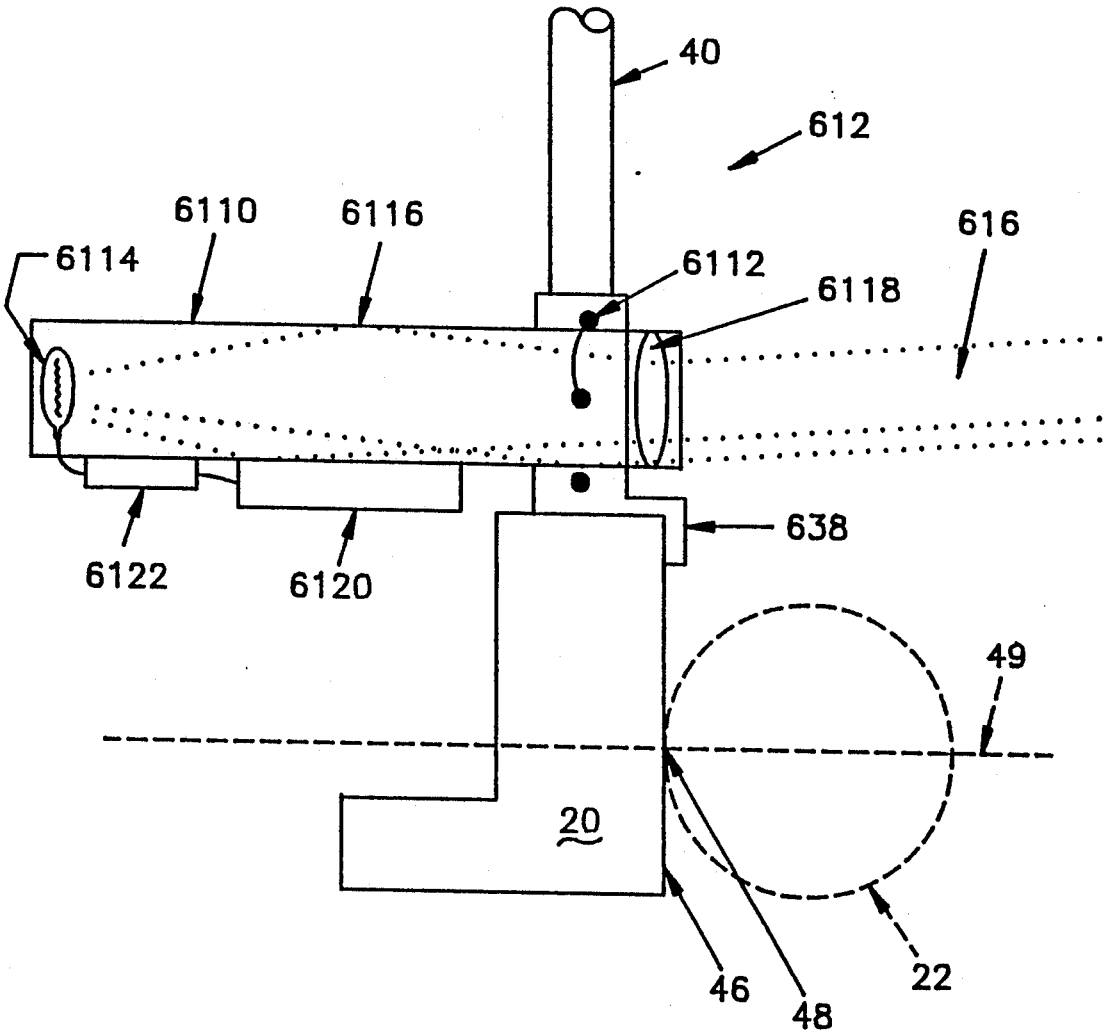
FIG. 6 is a partially cutaway side elevational view of an alternate embodiment, having an alignment beam assembly, shown installed upon a conventional putter.

Referring now to FIG. 6, an alternate embodiment of the invention 610 is shown. The primary difference is a putter component which is illustrated and is referred to by the general reference character 612. For convention and ease of reference, elements which correspond to those appearing in the preferred embodiment will be referred to by the same reference number proceeded by the digit "6" (for example, the alternate putter component is referred to as "612"). New elements will be designated in order also beginning with the digit "6".

The alternate putter component 612 differs from the preferred putter component 12 in that the alternate putter component 612 includes the beam generating assembly 628 as well as a beam directing assembly 630. In the alternate embodiment the directed beam 616 is not a reflection of the electromagnetic waveforms 15 generated by the remote component 14 but is rather a collimated beam generated directly within the putter component 612. In the alternate embodiment 612, the beam generating assembly 628 includes a collimated beam source 6110 which is mounted directly on the putter 20 by a putter mount assembly 638 similar to that of the preferred embodiment. The collimated beam source 6110 is adapted to direct a focused electromagnetic beam 616 directly along a line in a vertical plane parallel to the putter axis 49 so as to impact a remote component 614 similar to that of the preferred embodiment. The remote component 614 is similar to that of the preferred embodiment except that it is not necessary to provide an emitter 68 or the associated structure. In this instance the sensor analyzer 98 is also simplified considerably. On the other hand, in order to allow successful operation over varying elevation conditions, it may be desirable to provide a vertically extending reflector on the remote assembly such that the focused electromagnetic beam 616 may be captured anywhere in a vertical extent and need not be aimed directly at the horizontal plane of the photosensors 69.

Also aimed at the same consideration is the optional attachment of an elevational pivot 6112 in the putter mount assembly 638. The elevational pivot 6112 permits the beam source 6110 to be tilted within a vertical plane so as to be directed more specifically at a target which is at a different elevation from the putter 20.

Although a variety of different structures may be envisioned for the collimated beam source 6110, the preferred alternate embodiment illustrated in FIG. 5, in a partially cutaway view, includes a light unit 6114 situated at the rear end of a focusing tube 6116. The hollow focusing tube 6116 acts to direct the entire output of the light unit 6114 in the general direction of the putter axis 649. One or more lens elements 6118 are imposed within and at the front end at the focusing tube 6116 to further focus and direct the collimated electromagnetic beam 616. Although a truly focused and collimated beam 616 is ordinarily not achievable without laser technology (a possible alternate beam source 6110) it has been found that a proper use of the focusing tube 6116 and lens elements 6118 can result in a collimated electromagnetic beam 616 which does not spread unduly over the distances utilized in putting practice.

Since the alternate embodiment 610 has the beam generating assembly 628 mounted on the putter 620, it is also necessary to provide components to provide power and control. Accordingly, a battery 6120 and a control module 6122 are also mounted on the putter mount assembly 638. The battery 6120 may be selected from any of a wide variety, and is merely required to power the light unit 6114 and the other functions of the control module 6122. The control module 6122 includes an on/off component, beam modulation component (if desired) and any optional features.

One envisioned optional feature is an impact activation feature which would activate the light unit 6114 only in response to a specific occurrence, such as the impact of the putter blade 44 with a golf ball 22. The use of this feature, combined with a "catch-and-hold" feature in the signal control element 102 would be useful in determining the precise alignment of the putter face 46 at the actual point of impact during a putting stroke. The golfer would be able to utilize this feature to determine alignment at this instant only, it being recognized that the instant of impact is the most important.

Although a substantial number of features, embodiments and components have been discussed above for use with the invention 10 and 610, it is readily understood that an extremely wide variety of other embodiments and features may be incorporated. For example, the number of sensors 69 and associated signal lights 75 may vary widely.

Those skilled in the art will readily recognize that numerous other modifications and alterations of the specific structures, dimensions and components may be made without departing from the spirit and scope of the invention. Accordingly, the above disclosure is not to be considered as limiting and the appended claims are to be interpreted as encompassing the entire scope of the invention.

INDUSTRIAL APPLICABILITY

The putting stroke alignment system 10 and the alternate alignment system 610 of the present invention are primarily intended by use by golfers in practicing preparatory alignment for a putting stroke in order to improve their golf prowess. The use of the inventive system is based upon the premise that a proper precursor to a putting stroke is a prealignment stage characterized by the putter face 46 being aligned such that the putter axis 49 is directly aligned with a target. A successful stroke should have the same alignment, at least at impact For a flat putt, one with no "break" the target will coincide with the center of the putting cup 26. The invention is adapted to permit the practicing golfer to recognize when proper alignment with a particular target, represented by the center sensor 70 of the remote component 14, is achieved. By repetitive practice the golfer will begin to develop muscle memory as to the "feel" of the hands and putter when proper alignment is obtained. The sensory feedback generated by the signal assembly 34 will provide positive reinforcement to the golfer that a proper alignment has been achieved and thus will greatly enhance the value of putting practice.

The various alternate components of the signal assembly 34 are adapted for use with golfers having different styles of eye positioning during the putting stroke. The embodiments illustrated in the drawing (unless incorporating some of the enhanced signal features) require the golfer to look at the remote component 14 to determine whether proper alignment is achieved. An auditory feedback system such as the klaxon 82 allows the golfer to maintain eye contact with the ball 22 throughout the stroke and still determine whether proper alignment is achieved. Some of the alternate sensory signal generators 108 also provide feedback which does not require the golfer to turn the head to look at the remote assembly 14. Although these alternate sensory signals complicate the invention and increase the cost, they may be worthwhile in the case of many golfers.

When a golfer wishes to use putting practice system 10, the putter component 12 must first be assembled. If the golfer's usual putter 20 is utilized the putter mount assembly 38 will be attached and adjusted until the reflector 50 is aligned perpendicularly to the putter axis 49 (or the collimated beam source 6110 is parallel thereto). Naked eye adjustment may be sufficient in many cases, but special alignment hardware may be desirable for this purpose.

The target, in the form of the remote component 14, is then arrayed as desired. If a support structure 60, such as illustrated in conjunction with the preferred embodiment 10, is utilized, this will be placed on the putting surface 24 in the desired location, with the component assembly 36 attached thereon. The positioning base 60 is adapted to be used directly with a putting cup 26, or may be placed on any flat surface. The component structure 38 may be secured by any other means, as well.

Once the remote target component 14 has been positioned, the electronics are activated by toggling the on/off switch 90. With the preferred embodiment 10 it is preferable to allow a calibration delay (5–10 seconds) for the channel calibration loops 118 to define $V_B$ and to otherwise adjust the electronics to compensate for the background and environmental conditions. During the calibration delay it is necessary that the reflector 50 be situated such that the beam 16 is not directed at any of the sensors 69, since this would prevent calibration by triggering the positive signal interrupt 134, thus disabling the channel calibration loops 118.

After the calibration delay the practice session is ready to begin. The golfer selects an appropriate distance (up to about 10 meters) from the target and begins alignment. The fast emitter gain loop 114 will nearly instantaneously adjust to the distance selected and the threshold loop 116 will define the signal intensity threshold appropriately for such in an egually short time.

If the golfer wishes to concentrate exclusively on static alignment, no ball 22 or other prop need be used. The golfer merely attempts alignment and observes the condition of the signal lights 75 to check on the effectiveness of the effort.

With the recognition analysis module 110 and the timed interrupt 112 active, the golfer may perform the predefined action (a quick side to side flick of the putter in the preferred embodiment 10) and disable in the sensory output so as to practice unaided alignment. When the time interval has passed the displays are reactivated and the golfer may determine how effective the unaided naked eye alignment has been.

If the golfer wishes to practice an actual putting stroke than the golf ball 22 and putting surface 24 are required. Additionally, the optional sensory outputs such as the klaxon 82 and the sensory signal generators 108 would be desirable to allow the golfer to visually concentrate on the stroke, while receiving alignment analog information. Some stroke practice value may be achieved without these enhancements, particularly for those golfers who look at the target during the stroke, but this is limited.

The adaptability and portability of the system facilitate storage in a golfer's locker or vehicle trunk so as to encourage practice. The rapid and automatic adaptation to various distances and conditions result in ease of use. These user friendly features increase the probability that the system 10 will actually be used, and benefits will be derived therefrom, rather than the equipment being left to gather dust.

Since the structures of the invention may be constructed of ordinary materials and with off-the-shelf components, it is expected that the system may economically manufactured so as to be affordable to a wide variety of golfers. Since the typical golfer is extremely interested in improving the quality of the game, in particular the quality of the putting stroke, it is expected that there will be substantial demand for the putting alignment practice system 10. Accordingly, it is expected that the putting practice alignment system 10 of the present invention will have industrial applicability and commercial utility which are both widespread and long lasting.

I claim:

1. A putting improvement system for golfers, comprising;

electromagnetic beam generation means for generating electromagnetic energy;

beam directing means attached to a golf putter, for creating an alignment beam, said alignment beam being a portion of said electromagnetic energy subsequent to encountering the beam directing means, the beam directing means being arrayed so as to be effectively perpendicular to face of the putter;

beam receiving means for placement at a location remote from said putter, the beam receiving means being attuned to said alignment beam; and signal means for generating a sensory signal under conditions where a preselected intensity level of said alignment beam impinges on the beam receiving means; wherein the electromagnetic beam generation means and the beam receiving means are situated in close proximity to each other on a remote target unit and said beam directing means is in the form of a focusing reflector mounted on the putter; and said focusing reflector is shaped so as to direct said alignment beam into the form of a vertically extending, horizontally narrow slot shape, with the intensity thereof being generally uniform throughout said slot.

2. The putting improvement system of claim 1 wherein said beam is in the form of visible light.

3. The putting improvement system of claim 1 wherein the beam receiving means includes at least three horizontally spaced apart sensing elements, having a center sensor corresponding to the horizontal position of the desired target of alignment and at least one left offset sensor and at least one right offset sensor.

4. The putting improvement system of claim 1 wherein the signal means includes at least three alignment indicators, with a center indicator indicating that said putter face is aligned so as to be perpendicular to a line extending between said putter face and the beam receiving means, a left offset indicator indicating that said putter face is aligned left of said line and a right offset indicator for indicating that said putter face is aligned right of said line.

5. A putter alignment system for use in conjunction with a golf putter to aid in training a golfer to precisely align the face of the putter so as to be perpendicular to a desired target, comprising:

a putter component mounted upon the putter so as to move in conjunction therewith, the putter component including a beam directing assembly for directing a focused waveform;

a remote target component for placement at a location set apart from the putter component, the remote target component including a waveform sensing assembly for sensing said focused waveform;

a waveform generation assembly mounted on the remote target component for generating a waveform, and a signal generation assembly for generating one or more alignment signals, said alignment signals corresponding to the output of said waveform sensing assembly, wherein said signals are directly analogous to the horizontal alignment of the impact surface of the putter with respect to a preselected target, said preselected target having a fixed spatial relationship to the remote target component, the waveform generation assembly is mounted on the remote target component with the waveform output thereof emanating from a position vertically aligned with said preselected target; and said beam directing assembly includes a reflective element for reflecting and focusing said waveform into the form of a vertically extending slot shape such that when said impact surface is horizontally aligned with said preselected target, said focused waveform is directed toward said preselected target.

6. The putter alignment system of claim 5 wherein said waveform is electromagnetic energy within the spectrum including visible light and infrared energy.

7. The putter alignment system of claim 5 wherein said waveform sensing assembly includes a sensor array including plurality of horizontally spaced apart sensors for sensing said focused waveform, said sensor array including at least a center sensor vertically aligned with said target element, a left offset sensor, and a right offset sensor.

8. The putter alignment system of claim 7 wherein said alignment signals generated in correspondence with each of said sensors of said sensor array are mutually distinguishable.

9. The putter alignment system of claim 5 wherein the signal generation assembly includes a plurality of signal lights mounted on the remote target component so as to be readily visible to a person wielding the putter, said plurality of signal lights including at least a center light corresponding to approximately perfect alignment, a left offset light corresponding to slightly left offset alignment and a right offset light corresponding to slightly right offset alignment.

10. An alignment system for use in aiding horizontal alignment of a golf putter with respect to a preselected target, the putter including an optimum impact point on the impact surface thereof, defining a vertical putter axis plane perpendicular to the impact face of the putter and passing through the optimum impact point and further defining a vertical alignment plane containing the optimum impact point and the preselected target, comprising:

waveform generating means for generating a waveform to travel intermediate the vicinity of the putter and the preselected target;

a putter mounted component including waveform directing means for operating on said waveform and forming a delimited beam of said waveform, said waveform directing means being centered on the putter axis plane; and a target component for supporting the preselected target at a location remote from the putter, including electronic sensing means for sensing said delimited beam, electronic analysis means for analyzing the output of said sensing means and generating analog outputs in respect thereto and signal means for generating alignment signals in response to said analog outputs, wherein, said sensing means includes at leas a center sensor lying within the alignment axis plane and said analysis means and said signal means are together adapted to generate a distinguishable signal corresponding to approximately coplanar alignment of the putter axis plane and the alignment axis plane, the waveform generating means is an effective point source of electromagnetic energy situated on the target component within the alignment axis plane; and said waveform directing means is in the form of a reflecting component, arrayed perpendicularly to the putter axis plane, for reflecting the output of said point source in such a manner that the portion of said waveform reflected thereby is said delimited waveform, said delimited waveform being characterized by having the cross sectional shape of a vertically extending , horizontally narrow slot.

11. The alignment system of claim 10 wherein said sensing means include an array of offset sensors horizontally spaced apart from said center sensor and said analysis means and said signal means are together adapted to generate mutually distinguishable offset signals corresponding to a preselected intensity of said delimited waveform impacting one or more of said offset sensors, each said offset signal corresponding to the putter axis plane being offset from the alignment axis plane.

12. The alignment system of claim 10 wherein said alignment signals are in the form of visible light outputs from signal lamps arrayed on the target component in a horizontally spaced array including at least a center lamp in the alignment axis plane and a plurality of offset lamps, said offset lamps, when lit, indicating the position of the putter axis plane.

* * * * *